United States Patent [19]

Ball et al.

[11] Patent Number: 4,897,442

[45] Date of Patent: Jan. 30, 1990

[54] ANTI-WICK AGENT FOR TEXTILE PRINTING

[75] Inventors: Lawrence E. Ball, Akron, Ohio; Robert O. Rau, Greenville, S.C.; Philip Smith, Akron, Ohio

[73] Assignee: The Standard Oil Company, Cleveland, Ohio

[21] Appl. No.: 217,201

[22] Filed: Jul. 11, 1988

[51] Int. Cl.[4] ..... C08L 37/00

[52] U.S. Cl. ..... 524/549; 524/555; 524/560

[58] Field of Search ..... 526/271, 307.6, 318.4; 524/549, 555, 560

[56] References Cited

U.S. PATENT DOCUMENTS

| | | | |
|---|---|---|---|
| 2,244,704 | 8/1937 | Brubaker et al. | 526/318.4 |
| 3,390,010 | 6/1968 | Frerker et al. | 117/161 |
| 3,798,171 | 3/1974 | Ishi et al. | 526/271 |
| 3,802,905 | 4/1974 | Beyer et al. | 117/38 |
| 3,861,869 | 1/1975 | Schwindt et al. | 8/62 |
| 3,957,427 | 5/1976 | Chambers | 8/62 |
| 3,978,016 | 8/1976 | Perronin et al. | 524/555 |
| 4,104,214 | 8/1978 | Meierhoefer | 524/560 |
| 4,110,291 | 8/1978 | Barabas et al. | 260/29.6 |
| 4,120,841 | 10/1978 | Takahashi et al. | 526/318.4 |
| 4,172,177 | 10/1979 | Sato | 526/271 |
| 4,222,740 | 9/1980 | Bohrn et al. | 8/66 |
| 4,289,678 | 9/1981 | Calder et al. | 526/318.4 |
| 4,330,293 | 5/1982 | Lindemann | 8/495 |
| 4,543,371 | 9/1985 | Gallop et al. | 524/555 |
| 4,596,841 | 10/1978 | Konishi et al. | 524/555 |

OTHER PUBLICATIONS

BF Goodrich Company, "Textile Pigment Printing with Carbopol® Resins", Mar. 1984.

Dyers Company Publications Trust, "Textile Printing", 1981, pp. 232–264.

*Primary Examiner*—Joseph L. Schofer

*Assistant Examiner*—A. H. Walker

*Attorney, Agent, or Firm*—D. P. Yusko; D. J. Untener; L. W. Evans

[57] ABSTRACT

The spread of printing paste when applied to textiles is inhibited by the inclusion of an "anti-wick agent" in the print paste. The "anti-wick agent" comprises a copolymer resulting from the polymerization of at least one monomer selected from the group consisting of methacrylic acid, acrylic acid, maleic acid and maleic anhydride with at least one monomer selected from the group consisting of acrylate esters and N-substituted acrylamides.

7 Claims, No Drawings

ANTI-WICK AGENT FOR TEXTILE PRINTING

FIELD OF THE INVENTION

This invention relates broadly to acrylate ester copolymers which are useful as "anti-wick agents" for textile copolymers which are useful as "anti-wick agents" for textile printing. More specifically, this invention relates to a copolymer of at least one of methacrylic acid, acrylic acid, maleic acid or maleic anhydride with at least one acrylate ester or N-substituted acrylamide. These copolymers are very effective in inhibiting the spread of printing paste pigments when applied to textiles.

DESCRIPTION OF THE PRIOR ART

As used herein, the term "textiles" primarily means flat or cloth fabric in woven or non-woven form; but the invention described herein also has utility with pile fabric such as upholstery fabric and pile carpeting, produced using any conventional type of semi-synthetic, synthetic or natural fiber.

Textile printing makes use of an aqueous "print paste" which is applied to cloth via a design device such as a screen print or roller printer to give a pattern followed by a drying step. The paste contains (1) emulsified pigment for color, (2) thickener for rheology control, and (3) binders to "fix" the pigment to the cloth. Other agents such as a fixer, a softener and an antifoam agent are also typically added.

A common problem with most print paste formulations is the tendency of the pigments in the print paste to spread as the print paste is absorbed into the textile fibers. More specifically, the fiber strands in the textile, in addition to absorbing the pigment, carry away the pigment by capillary action from the point of application. Essentially, this is the same principle as is seen in a wick in an oil lamp or a candle where fuel is conveyed by a fibrous wick to the flame. In textile printing, this results in prints which appear blurred or prints which exhibit overlapping colors.

Solutions to the spread or "wicking" effect have been to add additional thickeners to the viscosity of the already viscous print paste. However, such printing pastes are difficult to work with and can clog the screen or roller printer. Special anti-wick additives, hereinafter referred to as "anti-wick agents", have been developed and are commercially available. However, most of these anti-wick agents tend to increase the viscosity of the print paste and consequently suffer from the same shortcomings described above.

The present invention provides a means for imparting color and printing to textiles which inhibits the spread of pigment thereby achieving excellent print and pattern definition. As such, this invention provides considerable freedom for making color designs and precise pattern prints. Further, the instant invention inhibits the spread of pigment without adversely affecting the viscosity of the print paste.

SUMMARY OF THE INVENTION

The spread of printing paste when applied to textiles is inhibited by the inclusion into the printing paste of an "anti-wick agent" comprising the copolymer resulting from the polymerization of at least one monomer selected from the group consisting of methacrylic acid, acrylic acid, maleic acid and maleic anhydride with at least one monomer selected from the group consisting of acrylate esters and N-substituted alkyl acrylamides.

DETAILED DESCRIPTION OF THE INVENTION

The Anti-Wick Agent

The anti-wick agents of the present invention are copolymers resulting from the polymerization of at least one first monomer selected from the group consisting of acrylic acid, methacrylic acid, maleic acid and maleic anhydride with at least one second monomer selected from the group consisting of (a) acrylate esters of the formula

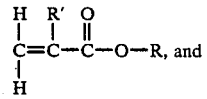

(b) N-substituted alkyl acrylamides of the formula

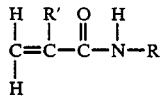

wherein R in the above formulas is a $C_1$–$C_8$ alkyl group and R′ in the above formulas is H or $CH_3$. Representative acrylates include methyl acrylate, ethyl acrylate, propyl acrylate, isopropyl acrylate, butyl acrylate, isobutyl acrylate, methyl methacrylate, methyl ethacrylate, ethyl methacrylate, octyl acrylate, heptyl acrylate, octyl methacrylate, isopropyl methacrylate, 2-ethylhexyl acrylate, hexyl acrylate, N-hexyl methacrylate, and the like. Representative N-substituted alkyl acrylamides include acrylamide, methacrylamide, N-methyl acrylamide, N-t-butyl acrylamide, N-cyclohexyl acrylamide, N-ethyl acrylamide and the like.

Preferred first monomers are acrylic acid and methacrylic acid. More preferred is methacrylic acid.

Preferred second monomers are the $C_1$ to $C_8$ acrylate esters. More preferred are the $C_1$ to $C_4$ acrylate esters. Most preferred is ethyl acrylate (i.e. the $C_2$ acrylate ester).

Preferably, the anti-wick agent contains about 50 to about 70 wt. percent of the first monomer. More preferred is an anti-wick agent containing about 60 wt. percent of the first monomer and 40 wt. percent of the second monomer.

The anti-wick agents of the present invention may also include minor amounts of up to about 20 wt. percent of other polymerized vinylidene monomers containing at least one terminal $CH_2{=}C<$ group. Such materials include, for example, acrylic ester monomers including those acrylic ester monomers having long chain aliphatic groups such as derivatives of an acrylic acid represented by the formula:

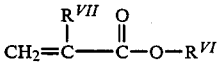

wherein $R^{VI}$ is an alkyl, aryl, or alkyl/aryl group having from 10 to 30 carbon atoms, preferably 10 to 20 carbon atoms and $R^{VII}$ is hydrogen or a methyl or ethyl group. Representative higher alkyl acrylic esters are decyl acrylate, isodecyl methacrylate, lauryl acrylate, stearyl acrylate, behenyl acrylate and melissyl acrylate and the corresponding methacrylates. Other vinylidene monomers such as the $\alpha,\beta$-olefinically unsaturated nitriles may also be used. The $\alpha,\beta$-olefinically unsaturated nitriles useful in the interpolymers embodied herein are preferably the monoolefinically unsaturated nitriles having from 3 to 10 carbon atoms such as acrylonitrile, methacrylonitrile, ethacrylonitrile, and the like. Most preferred are acrylonitrile and methacrylonitrile. Included are other acrylic amides such as N-alkylol amides of alpha, beta-olefinically unsaturated carboxylic acids including those having from 4 to 10 carbon atoms such as N-methylol acrylamide, N-ethanol acrylamide, N-propanol acrylamide, N-methylol methacrylamide, N-ethanol methacrylamide, N-methylol maleamide, N-methylol maleamic acid, N-methylol maleamic acid esters, the N-alkylol amines of the vinyl aromatic acids such as N-methylol-p-vinyl benzamide, N-substituted alkoxymethyl acrylamides and the like. Other representative vinylidene monomers are the $\alpha$-olefins containing from 2 to 12 carbon atoms; dienes containing from 4 to 10 carbon atoms including butadiene; vinyl esters and allyl esters such as vinyl cetate, vinyl aromatics such as styrene; vinyl and allyl ethers and ketones such as vinyl methyl ether and methyl vinyl ketone; cyanoalkyl acrylates such as methyl $\alpha$-cyano acrylate, the propyl $\alpha$-,$\beta$- and $\alpha$-cyano acrylates, vinyl halides and vinyl chloride, vinylidene chloride and the like; esters of maleic and fumaric acid and the like.

Optionally, the anti-wick agent may be cross-linked with any polyfunctional vinyl or vinylidene monomer containing at least 2 terminal $CH_2{=}C<$ groups, including for example, butadiene, isoprene, divinyl benzene, divinyl naphthalene, allyl acrylates and the like. Particularly useful cross-linking monomers are polyalkenyl polyethers having more than one alkenyl ether grouping per molecule. The most useful crosslinkers possess alkenyl groups in which an olefinic double bond is attached to a terminal methylene $CH_2{=}C<$ group. These are made by the etherification of a polyhydric alcohol containing at least 4 carbon atoms and at least 3 hydroxyl groups. Compounds of this class may be produced by reacting an alkenyl halide, such as allyl chloride or allyl bromide with a strongly alkaline aqueous solution of one or more polyhydric alcohols. The product is a complex mixture of polyethers with varying numbers of ether groups. Analysis reveals the average number of ether groupings on each molecule. Efficiency of the polyether cross linking agent increases with the number of potentially polymerizable groups on the molecule. It is preferred to utilize polyethers containing an average of two or more alkenyl ether groupings per molecule. Representative of other cross-linking monomers are diallyl esters, diallyl ethers, allyl acrylates, methacrylates and acrylamides, and methacrylamides, tetraallyl tin, tetravinyl silane, polyalkenyl methanes, diacrylates, and dimethacrylates, divinyl compounds such as divinyl benzene, polyallyl phosphate, diallyloxy compounds, diallyloxy phosphite esters and the like. Typical agents are triallyl pentaerythritol, trimethylolpropane triacrylate, 1,6-hexanediol diacrylate, trimethylol-propane diallyl ether, trimethylolpropane triallyl ether, pentaerythritol triacrylate, tetramethylene dimethacrylate, tetramethylene diacrylate, ethylene diacrylate, ethylene dimethacrylate, triethylene glycol dimethacrylate, and the like. When the optional cross-linking agent is present, the polymeric mixtures usually contain up to about 5% by weight of cross-linking monomer based on the amount of the carboxylic acid monomer and other monomers, if present. More preferably the mixture contains about 0.1 to 2.0 weight percent of crosslinker.

Polymerization of the monomers is carried out in aqueous media in the presence of a free radical catalyst and one or more surfactants in a closed vessel in an inert atmosphere under autogenous pressure or artificially-induced pressure, or in an open vessel under reflux at atmospheric pressure. Temperature of the polymerization may be varied from about 1° to 100° C. or lower or higher, depending to a degree on the molecular weight desired in the polymer. Polymerization at 25° to 90° C. under autogenous pressure using a free radical catalyst is generally effective in producing polymer yields of 75% to 100%. Preferably the polymerization temperature is between 40° and 80° C.

Polymerization of the monomers is carried out in the presence of a free radical catalyst. Typical free radical forming catalysts include peroxygen compounds such as sodium, potassium and ammonium persulfates, caprylyl peroxide, benzoyl peroxide, hydrogen peroxide, pelargonyl peroxide, cumene hydroperoxides, tertiary butyl diperphthalate, tertiary butyl perbenzoate, sodium peracetate, sodium percabonate, and the like, as well as azo catalysts and azobis-isobutyryl nitrile, hereinafter referred to as azoisobutyronitrile. Other typical catalysts are the so-called "redox" type of catalyst and the heavy-metal activated catalyst systems. Included within this list are watersoluble persulfates such as sodium persulfate, potassium persulfate and ammonium persulfate; the combination of one of the water-soluble persulfates with a reducing agent, such as a polyhydroxy phenol, an oxidizable sulphur compound such as sodium meta-bisulfite, sodium sulfite, thiosulfite and the like; the combination of a water-soluble persulfate and dimethylaminopropionitrile; the combination of a watersoluble persulfate with a reducing sugar or with a combination of a dimercapto compound and a water-soluble ferricyanide compound; and the like. Heavy metal ions which greatly activate the water soluble persulfates are the transition metals in their lower valence states, e.g. cuprous, ferrous and cobaltous. The preferred range of catalyst during polymerization is from about 0.01 to 5 parts by weight per one-hundred parts by weight of monomers. Lastly, ultra-violet light and high energy radiation may also be used as a source of free radicals.

In the practice of the invention, the polymerization reactors may be either batch, semi-batch or continuous. The agitation may be any agitation sufficient to maintain the emulsion and obtain effective heat transfer including, for example, marine agitators, pitched turbines and the like. The monomer may be batch charged or continuously added during the course of polymerization or by any other manner of polymerization techniques conventionally used. Where monomer is continuously added during the course of polymerization, typically up to 40 wt. percent of the monomer is initially present in the reactor with the remaining monomer added during the course of polymerization. Polymerization time can extend as long as 12 hours. Normal polymerization time is one hour or less.

The latex resulting from the above polymerization is the anti-wick agent and comprises about 10 to 25 wt. percent polymer solids. Preferably the anti-wick agent contains about 15 to 20 wt. percent polymer solids.

The Printing Paste

As stated earlier, printing paste typically contains (1) about 0.5 to about 25 wt. percent emulsified pigment for color, (2) about 2 to about 4 wt. percent thickener for rheology control, (3) about 5 to about 15 wt. percent binder which fix the pigment to the textile, (4) less than about 5 wt. percent softeners, antifoam agent and fixers, and (5) the remainder being water. The amount of pigment employed is dependent upon the color of the print paste. The thickeners typically comprise polymers or copolymers of acrylic acid (or some other carboxyl group containing polymer) which have been neutralized with a base such as ammonium hydroxide and which are suspended in an aqueous or organic medium. These copolymers may also incorporate a polymerized crosslinking monomer. The "binder" is a multipolymer (some contain acrylate esters, some are rubber latexes, some contain vinyl acetate) whose purpose is to "fix" the pigment to the fabric. Softeners are used to soften the feel of the printed fabric. "Fixers" like "binders" are added to enhance the adhesion of the pigment to the fabric.

The anti-wick agent comprises between about 0.1 and about 3 wt. percent of the printing paste. Preferably the anti-wick agent comprises between about 0.5 and about 2.0 wt. percent of the printing paste.

A benefit to the anti-wick agents of the instant invention is that they have no adverse affect on the viscosity of the print paste. These anti-wick agents will not increase the viscosity of the print paste such that the print past is too thick for screen or roller printers. In most cases, these anti-wick agents will slightly decrease the viscosity of the print paste.

SPECIFIC EMBODIMENTS

In order to better illustrate the instant invention, the following examples are provided:

EXAMPLE 1

Preparation of the Anti-Wick Agent

Into a one liter resin kettle blanketed with argon and equipped with a mechanical stirrer, reflex condensor, thermocouple and gas inlet tube, the following ingredients were charged with agitation in the order indicated:

648 g. distilled water,
10.43 g. sodium alkyl olefin sulfonate (Witconate AOS-40% active),
2.37 g. octylphenyl - polyethylene ether alcohol (Triton X-305-70% active),
120 g. methacrylic acid
80 g. ethylacrylate The above mixture was brought to 50° C. under agitation and inert gas purge. An initiation, 0.6 g. ammonium persulfate and 0.6 g. sodium meta-bisulfate was then added.

Heating was discontinued and the exothermic reaction was allowed to proceed to completion. The peak temperature in the reactor was 72° C. after 18 minutes. The latex was allowed to cool to room temperature and was poured off through cheese cloth (3 g. wet prefloc).

The final latex contained a 60 wt. percent methacrylic acid/40 wt. percent ethylacrylate copolymer and had a total solids content of 22.6 wt. percent.

EXAMPLE 2

Preparation of the Print Paste

Using a high speed shear mixer, 98 g. of water and 2 g. of a water thickening agent (PasteMaker TM 330[1]) are combined with agitation for 2 to 4 minutes. The thickening agent increased the viscosity of the water to provide a mixture with the rheological properties necessary for a good print paste. This mixture is called in the trade a "cut clear". After the "cut clear" was well mixed, its viscosity was measured on a Brookfield Viscometer, model RVF with the speed setting at 20.

[1]PasteMaker TM 330 is a product of BP Chemicals International containing mineral spirits, neutralized crosslinked polyacrylic acid and several surfactants. PasteMaker is a trademark of BP Chemicals America Inc., which is the legal entity of the U.S. Division of BP Chemicals International.

[2]PasteMaker TM HV binder is a product of BP Chemicals International.

[3]Imperon Blue N2G pigment is a product of American Hoechst Corp.

A print paste containing 0.5 wt. percent anti-wick agent was made by combining:

79.5 g. "cut clear"
10.0 g. PasteMaker TM HV[2] binder
10.0 g. Imperon Blue N2G[3] pigment
0.5 g. Anti-Wick Agent from Example 1

After these products are combined, they are mixed on a high speed shearing mixer for 2–4 minutes, and the viscosity is measured using the equipment identified above.

Using the above procedure, printing paste comprising 0, 1% and 2% of the anti-wick agent from Example 1 were also made. As the amount of anti-wick agent was increased or decreased, the "cut clear" portion of the print paste was adjusted by a corresponding amount. For example, a printing paste containing 2 wt. percent anti-wick agent comprised 78 g. "cut clear", 10 g. binder, 10 g. pigment and 2 g. antiwick agent. For comparison, other printing pastes were produced which incorporated anti-wick agents manufactured by Wamchem Chemical and Patchem Inc. in place of the anti-wick agent described in this specification.

EXAMPLE 3

Drop Test

The printing pastes made in Example 2 were tested on a fabric sheet made from durable press resin treated 50/50 polyester/cotton weighing 0.077 lbs./sq. yard. In order to test the anti-wick characteristics of the printing paste, one drop of the paste was placed on the fabric using an eye dropper. The droplet was allowed to air dry for one-half hour.

A printing paste which wicks will spread out evenly from the droplet and color an area larger than the size of the original drop. The area encompassed by the droplet was measured immediately after application to the fabric and once again after the droplet had dried. The differences between these two areas was used to calculate the percent spread of the printing paste. A lower spread percentage indicated better performance for the anti-wick agent in the print paste.

The results of the tests are shown in Table I and Table II.

TABLE I

"Drop Test" Data for Various Printing Paste Made From a "Cut Clear" Incorporating 2 wt. percent Thickener

| Anti-Wick Agent | Amount | % Initial Area sq. cm. | Final Area sq. cm. | Spread % | Printing Paste Viscosity (cps) |
|---|---|---|---|---|---|
| None | 0 | .38 | .95 | 60 | 6700 |
| Wamanti-wick 4180* | .5 | .38 | 1.13 | 66 | 9900 |
| Wamanti-wick 4180* | 1 | .50 | .79 | 37 | 10400 |
| Wamanti-wick 4180* | 2 | .38 | .38 | 0 | 15050 |
| Patchem** | .5 | .38 | .95 | 60 | 10100 |
| Patchem** | 1 | .38 | .64 | 41 | 8900 |
| Patchem** | 2 | .38 | .38 | 0 | 13000 |
| From | .5 | .38 | .50 | 24 | 4950 |
| Example 1 | 1 | .38 | .38 | 0 | 4500 |
| | 2 | .38 | .38 | 0 | 5050 |

*Product of Wamchem Chemical, a Division of Springs Industries, Lyman, S.C., Composition Unknown.
**Product of Patchem Inc., Greenville, SC., Composition Unknown

EXAMPLE 4

The procedure of Examples 2 and 3 were repeated except that the "cut clear" made in Example 2 contained 97.5 wt. percent water and 2.5 wt. percent thickener.

The results of testing various printing pastes made from this "cut clear" and incorporating representative amounts and variety of anti-wick agents are shown in Table II.

TABLE II

"Drop Test" Data for Various Printing Paste Made From a "Cut Clear" Incorporating 2.5 wt % Thickener

| Anti-Wick Agent | Amount (wt %) | Initial Area (sq. cm.) | Final Area (sq. cm.) | Spread % | Printing Paste Viscosity (cps) |
|---|---|---|---|---|---|
| None | 0 | .38 | .64 | 41 | 10200 |
| Wamanti-wick 4180 | .5 | .28 | .64 | 56 | 13200 |
| Wamanti-wick 4180 | 1 | .38 | .64 | 41 | 13700 |
| Wamanti-wick 4180 | 2 | .38 | .38 | 0 | 21250 |
| Patchem | .5 | .28 | .50 | 44 | 13600 |
| Patchem | 1 | .28 | .38 | 26 | 11200 |
| Patchem | 2 | .38 | .38 | 0 | 17500 |
| From | .5 | .38 | .44 | 14 | 7650 |
| Example 1 | 1 | .38 | .38 | 0 | 6650 |
| | 2 | .38 | .38 | 0 | 6800 |

EXAMPLE 5

Print Test

Print paste containing various amounts of anti-wick agent were prepared as in Example 2 and Example 4. The antiwick agent was prepared as in Example 1. The print paste was printed onto a 50/50 poly/cotton resin treated fabric from Fieldcrest Cannon using a Zimmer flat bed screen printer mini-MD FR-341 at medium conditions (i.e., Pressure=3, Speed=50). The print test consisted of printing a 2 in. x 4 in. rectangle through a 100 mesh screen and allowing the paste to air dry. The spread of the print paste was measured at eight different points on the perimeter of the rectangle (two on each face) and the average spread was calculated. The results of testing various print paste are shown in Table III.

TABLE III

"Print Test" Data for Various Printing Paste

| Anti-wick Agent | Amount (wt %) | Average Spread (mm) | Printing Paste Viscosity (cps) |
|---|---|---|---|
| Print Paste Made From a "Cut Clear" Incorporating 2.0 wt % Thickener | | | |
| Control | 0 | 2.175 | 6850 |
| From Example 1 | 1 | 0.8 | 5200 |
| | 2 | 0 | 5400 |
| Patchem | 1 | 1.175 | 9450 |
| | 2 | 0.575 | 14600 |
| Wamanti-wick 4180 | 1 | 0.925 | 11500 |
| | 2 | 0.55 | 17900 |
| Print Paste Made From a "Cut Clear" Incorporating 2.5 wt % Thickener | | | |
| Control | 0 | 1.4 | 10200 |
| From Example 1 | 1 | 0.625 | 7450 |
| | 2 | 0 | 7400 |
| Patchem | 1 | 1.025 | 14950 |
| | 2 | 0.725 | 24250 |
| Wamanti-wick 4180 | 1 | 1.00 | 18200 |
| | 2 | 0.35 | 26750 |

The data presented in Tables I, II and III illustrate that the anti-wick agents of the instant invention minimize the amount of spread of printing paste on fabric and are more effective in accomplishing this goal than commercially available products. The data also illustrates that the anti-wick agents of the instant invention has no adverse effect on print paste viscosity.

The foregoing embodiments of the present invention have been presented for purposes of illustration and description. These description and embodiments are not intended to be exhaustive or to limit the invention to the precise form disclosed, and obviously many modifications and variations are possible in light of the above disclosure. The embodiments were chosen and described in order to best explain the principle of the invention and its practical applications to thereby enable others skilled in the art to best utilize the invention in its various embodiments and with various modifications as are suited to the particular use contemplated. It is intended that the invention be defined by the following claims.

The claimed invention is:

1. A printing paste for textiles comprising water, emulsified pigment, thickeners, binders and an anti-wick agent, wherein the anti-wick agent consists essentially of a polymer resulting from the polymerization of at least one first monomer selected from the group consisting of methacrylic acid, acrylic acid, maleic acid and maleic anhydride, and at least one second monomer selected from the group consisting of acrylate esters of the formula:

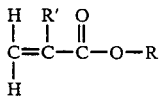

(I)

and N-substituted alkyl acrylamides of the formula

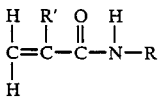

(II)

where R in formulas I and II is a $C_1$–$C_8$ alkyl group, and R, in formulas I and II is H or $CH_3$, and wherein the polymer consists essentially of from about 50 to 70 percent by weight of the first monomer and from about 30 to 50 percent by weight of the second monomer, and wherein the anti-wick agent comprises between about 0.1 and 3.0 weight percent of the printing paste.

2. The printing paste of claim 1 wherein the polymerized first monomer in the anti-wick agent is selected from the group consisting of methacrylic acid and acrylic acid, and the second monomer is an acrylate ester of the formula:

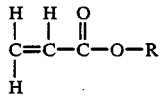

where R is a $C_1$–$C_8$alkyl group.

3. The printing paste of claim 1 wherein the polymerized first monomer in the anti-wick agent is methacrylic acid and the second monomer is ethyl acrylate.

4. The printing paste of claim 1 wherein said anti-wick agent comprises about 60% of the first monomer and about 40% of the second monomer.

5. The printing paste of claim 1, wherein the anti-wick agent comprises up to about 20 wt. percent of a polymerized vinylidene monomer containing at least one terminal $CH_2{=}C<$ group.

6. The printing paste of claim 1, wherein the anti-wick agent comprises up to about 5 wt. percent of a polymerized crosslinking monomer selected from the group consisting of monomers containing two terminal $CH_2{=}C<$ groups.

7. The printing paste of claim 1, wherein the anti-wick agent comprises between about 0.5 and about 1.0 wt. percent of the printing paste.

* * * * *

UNITED STATES PATENT AND TRADEMARK OFFICE

CERTIFICATE OF CORRECTION

PATENT NO. : 4,897,442

DATED : January 30, 1990

INVENTOR(S) : Lawrence E. Ball et al

It is certified that error appears in the above-identified patent and that said Letters Patent is hereby corrected as shown below:

Column 9, line 2, Claim 1, "R," should read --R'--.

Signed and Sealed this

Third Day of July, 1990

*Attest:*

*Attesting Officer*

HARRY F. MANBECK, JR.

*Commissioner of Patents and Trademarks*